US007077759B1

(12) United States Patent
McNulty

(10) Patent No.: US 7,077,759 B1
(45) Date of Patent: Jul. 18, 2006

(54) GOLF PUTTING TRAINING DEVICE

(76) Inventor: James Patrick McNulty, 551 Keating Rd., Fly Creek, NY (US) 13337

( * ) Notice: Subject to any disclaimer, the term of this patent is extended or adjusted under 35 U.S.C. 154(b) by 0 days.

(21) Appl. No.: 11/020,053

(22) Filed: Dec. 23, 2004

(51) Int. Cl.
*A63B 53/16* (2006.01)

(52) U.S. Cl. ..... 473/257; 473/473; 473/261; 473/262; 473/265; 473/278

(58) Field of Classification Search ..... 473/157, 473/218, 257, 261–268, 278, 407, 422; D21/791
See application file for complete search history.

(56) References Cited

U.S. PATENT DOCUMENTS 2,992,005 A * 7/1961 Lockhart ..... 473/257
3,357,705 A 12/1967 Blanchard
3,918,720 A 11/1975 Gordo
4,278,254 A 7/1981 Simjian
4,411,431 A 10/1983 Judice
4,805,912 A * 2/1989 Hickman ..... 473/159
5,595,546 A * 1/1997 Masters ..... 473/280
5,885,165 A * 3/1999 Krause ..... 473/200
6,159,106 A * 12/2000 Adams ..... 473/265
6,280,345 B1 * 8/2001 St. Martin ..... 473/278
D461,517 S * 8/2002 Morgan et al. ..... D21/791

* cited by examiner

*Primary Examiner*—Nini F. Legesse

(57) ABSTRACT

There is provided a golf putting training apparatus that is portable and operable with standard USGA golf equipment. The apparatus include parallel channels each emanating from a respective dimple. The channels are separated by a distance such that a golf ball placed on each dimple can be simultaneously using a standard putter, but also so that the golf balls do not contact each other. A chamfered portion allows the golf balls to roll continously off of the apparatus and onto an undersurface. By measuring the distance that each golf ball travels, a golfer gauges the accuracy of his swing. An obverse surface of the apparatus contains indicia that assists a golfer in aligning his positioning and stroke.

11 Claims, 4 Drawing Sheets

GOLF PUTTING TRAINING DEVICE

FIELD OF THE INVENTION

The present invention generally relates to the field of golf and, more particularly, to a device that improves a golfer's putting stroke.

BACKGROUND OF THE INVENTION

Golf putting training devices are generally known and are used to improve a golfer's putting stroke. Many of these devices require the use of non-standard equipment to give a golfer an opportunity to improve his putting stroke. However, these devices fail to allow the golfer to grasp putting improvement with the feel of his regular equipment. Thus, the improvement usually results in an improvement in using the particular device and not an improvement in real golf putting overall.

For example, U.S. Pat. No. 3,357,705 to Blanchard describes using a pair of golf balls joined by a flexible member. This device allows a golfer to take a full swing with any club whereby the projectile travels only a short distance. However, there is no way to accurately gauge the trueness of the swing using this projectile. Further, the projectile is a non-standard piece of equipment that does not feel like the real thing. One might as well swing his club at a pillow cushion if his concern is a shortness of distance.

U.S. Pat. No. 3,918,720 to Gordo shows a putting training apparatus in which two golf balls are joined by a rigid rod. Each of the balls are struck simultaneously by a putter. If both balls are struck at the same time the apparatus moves in a straight line. Again this device does not move as a real golf ball, but moves more as a wheel set, thus depriving the user of the feel of striking a real golf ball. Further, one slight foreign object in the path of either ball caused the apparatus to pronouncedly ramble off course.

U.S. Pat. No. 4,278,254 to Simjian offers a golf putting device wherein a golf ball is suspended between two wheels. If the wheels are struck simultaneously, the device travels in a straight line. Once again, this device does not offer the golfer an opportunity to practice with a real golf ball. Further, a pronounced curvature of travel occurs where either wheel strikes a foreign object on the surface.

U.S. Pat. No. 4,411,431 to Judice describes also a pair of golf balls joined by a rigid member. One of the balls is struck along the axis defined by the rigid member. If the ball is squarely struck, then both balls travel along the axis defined by the rigid member. Otherwise, the balls travel angularly. This device has the same shortcomings as those to Gordo and Simjian.

U.S. Pat. No. 4,805,912 to Hickman shows a golf putting teaching aid which includes a rectangular putting surface having a putter line located lengthwise down the surface. The golfer swings and gauges the accuracy and force of his swing by observing the path of the ball in relation to the putting line. One problem with this device is that it is bulky and non-transportable.

SUMMARY AND OBJECTS OF THE PRESENT INVENTION

It is an object of the present invention to improve the art of golf and more particularly the art of putting.

It is another object of the present invention to provide a golf putting training device that is portable.

It is still another object of the present invention to provide a golf putting training device that allows a golfer to improve his putting using standard United States Golf Association ("USGA") equipment that the golfer typically carries in his own golf bag.

It is yet another object of the present invention to provide a golf putting training device that fits into the golfer's bag.

It is a further object of the present invention to provide a golf putting training device that includes relevant indicia which assists the golfer in aligning his stroke.

These and other objects are provided by a golf putting practice apparatus in which an obverse surface includes a pair of substantially identically shaped parallel golf ball channels, wherein each of the channels include sufficient width and depth to allow a golf ball to travel therein. An intermediate area separates the channels. The intermediate area is of sufficient width such that a pair of golf balls placed side by side in each of the channels do not contact each other. The intermediate area is also of such a width that each of the placed golf ball can be struck simultaneously with a standard USGA putter.

Each of the channels emanates from a respective channel dimple. Ideally these dimples are separated on-center by approximately $1\frac{13}{16}$ inches. A central dimple disposed in the intermediate area allows a golfer to use a single ball for target practice.

Each of the channels progresses in a uniform upwardly inclined plane, wherein the inclined planes terminate at a chamfered portion of the surface.

A swing vertex line defines the lowest point of a swing arc for properly striking the pair of golf balls. A hatched golf tee image impressed on the surface defines a properly directed swing arc. A top tee portion of the hatched golf tee image has a width substantially similar to the width of a standard USGA putter head.

Typically, the apparatus is one piece injection molded design or machined, preferably made of a polycarbonate material.

Optionally, the reverse surface of the golf putting device includes a second chamfered portion and a golf hole image such that a first apparatus can be used as a tee point while the second surface of a second apparatus can be used as a target. Thus, the apparatus can be flipped over for repeated target practice between the two.

BRIEF DESCRIPTION OF THE DRAWINGS

The present invention will be understood and appreciated more fully from the following detailed description taken in conjunction with the drawings in which.

DETAILED DESCRIPTION OF THE PRESENT INVENTION

Figure 1:
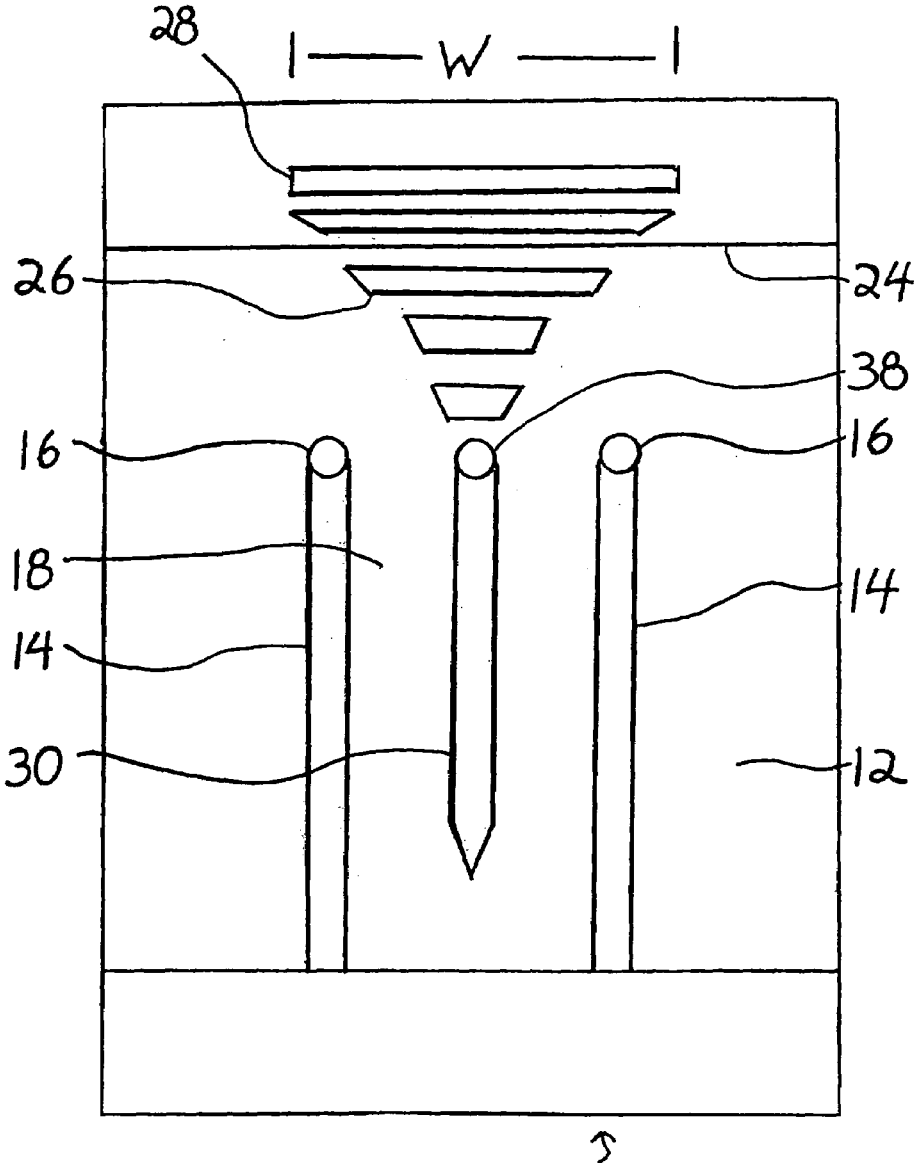
FIG. 1 is an obverse view of the playing surface of the apparatus in accordance with a preferred embodiment of the present invention.

The present invention will now be described in accordance with a preferred embodiment. Referring now to FIG. 1 a putting apparatus 10 includes a surface 12 that includes indicia and geometrical transgressions that allows a golfer to improve his putting using his or her own standard USGA putter and standard USGA golf balls. Thus extra equipment is not required to improve the putting swing.

The apparatus 10 is made of any suitable material, and is preferably one-piece injected molded or machined from a polycarbonate material.

The surface 12 includes a pair of substantially identical parallel situate channels 14. Each channel 14 is of sufficient width to allow the bottom surface of a golf ball to roll therein. Each channel 14 preferably emanates from a slight dimple 16 on the playing surface.

Figure 2:
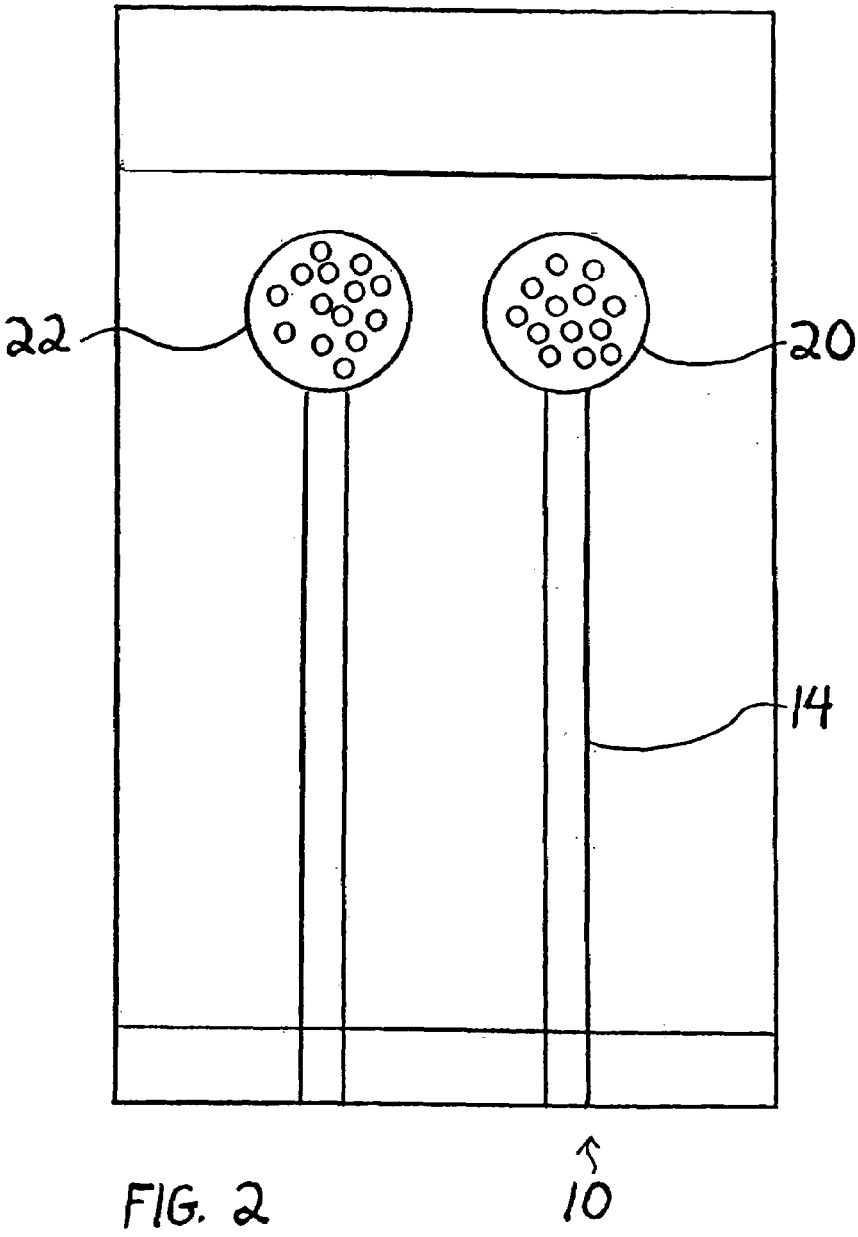
FIG. 2 is an obverse view of the playing surface of FIG. 1 having a pair of golf balls situate in accordance with the preferred embodiment of the present invention.

An intermediate area 18 separates the channels 14 by such a distance that a pair of golf balls 20, 22 placed side by side in each channel 14 will not contact each other depicted in FIG. 2. However, the width of the intermediate area 18 must be small enough so that each of the placed golf balls 20, 22 can be struck simultaneously by a standard USGA putter. In a preferred embodiment, the distance between the center of the channel dimples 16 is approximately 1 13/16 inches.

A swing vertex line 24 imprinted on the surface 12 at a position behind the dimples 16 defines the lowest point of a swing arc for properly striking the golf balls 20, 22. It should be understood that a proper putting stroke is one in which contact is made between the putter and the golf ball on a slightly upward arc just after reaching the lowest point of the swing arc. This contact imparts topspin to the ball which removes the tendency of ball to slide or bounce after being struck.

Thus, it is seen how the swing vertex line 24 aids a golfer in positioning himself and his swing in relation to the position of the golf ball. One simply lowers his putter and adjusts his position such that the head of the putter is directly over the swing vertex line 24 prior to his backswing.

A hatched cross sectional image of a golf tee 26 defines a proper directional swing arc. Thus, the golfer directs his swing from the top portion 28 of the golf tee image 26 such that the follow through of the swing arc is defined by the middle of the putter head being directly over a bottom portion 30 of the golf tee image 26. In fact, for further alignment it is desirable that the width (W) of the top portion 28 of the hatched golf tee image 26 be approximately the same as the length of the putter head.

In use, the golfer places two standard USGA golf balls 20, 22 or their equivalents in the dimples 16 on the playing surface 12. The dimples 16 are only slight depressions that prevent the golf balls 20, 22 from rolling away and also to keep the golf balls 20, 22 in a direct alignment with their respective channels 14.

The golfer then aligns himself such that the start point of his back swing begins directly over the swing vertex line 24. The golfer then follows through on his swing by gauging his swing directly through the hatched golf tee image 26. It should also be apparent with a further reading that the hatched golf tee image 26 and the swing vertex line 24 are not completely necessary for the use of the present invention but are valuable aids for the beginner.

As the golfer strikes the spaced golf balls 20, 22 with his putter the golf balls 20, 22 begin to travel down their respective channels 14. Assuming that the swing was proper, the golf balls 20, 22 are struck simultaneously. The golf balls 20, 22 travel down the channels 14 at the same rate and will come to rest at the same distance from their placement on their respective dimples 16.

Figure 3:
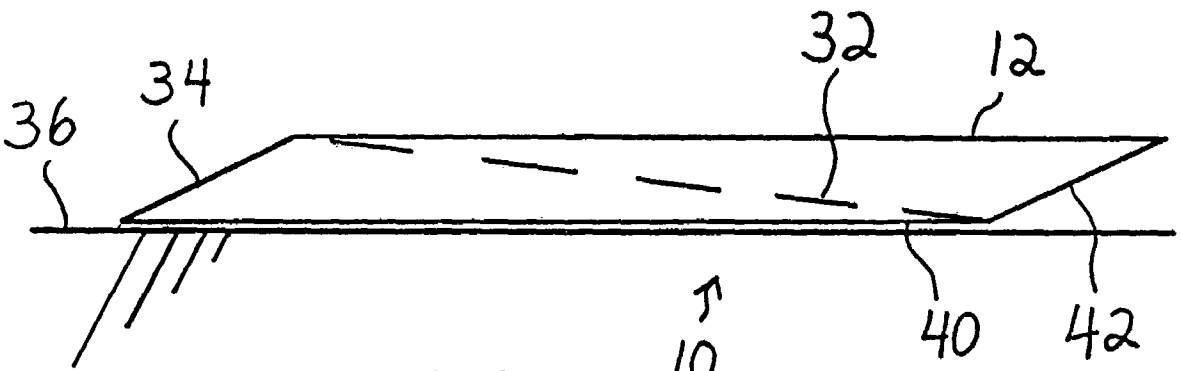
FIG. 3 is a side view of the apparatus of FIG. 1.

Each of the channels 14 extend from the dimples in a uniform upwardly inclined plane 32, depicted in FIG. 3, the purpose of which is to prevent the golf balls 20, 22 from jumping out of the channel 14.

The upward inclines 32 terminate at a chamfered portion 34 of the apparatus. The chamfered portion 34 allows the golf balls 20, 22 to uniformly roll down to an undersurface 36 with a smooth transition there between. Thus, the golf balls 20, 22 roll continuously off of the chamfered surface 34 and along the undersurface 36. The channels 14 may terminate completely at the beginning of the chamfered surface 34 or may extend therethrough.

For a proper swing, the golf balls 20, 22 roll off of the chamfered surface simultaneously and come to rest at distance substantially the same from their respective dimples 16. Thus, it is possible to measure the accuracy of the swing.

Lets assume now the swing is not proper, wherein the putter head strikes one of the golf balls before the other, at different angles or with a different force on each golf ball. To envision this scenario, assume that the golfer swings at the golf balls 20, 22 and strikes golf ball one 20 first with the rear of the putter head at a first angle. The front of the putter head continues instantaneously at the same speed, but the rear of the putter head slows down after striking the golf ball one 20. Thus, the angle of the club head swing becomes altered and the front of the putter head strikes golf ball two 22 at a second angle which is different than the first angle. Further, the overall club swing slows after contact is made with golf ball one 20, thus lessening the initial velocity to golf ball two 22.

Each of the golf balls 20, 22 now sets off on their unique irregular paths and differing speeds down their respective channel 14. The sides of the channels 14 absorbs some of the energy from the golf ball in proportion to the angle that the golf ball strikes the channel 14, thus slowing the velocity of the golf ball.

Each of the golf balls 20, 22 exits the chamfered portion 34 at different velocities, and thus comes to rest at different distances respective of the starting points. Therefore, the golfer simply observes the final placement of the golf balls to determine that his swing was incorrect.

Once the golfer masters the above aspect of the invention, he can now move on to an advanced aspect. Using a single golf ball disposed on a central dimple 38, the golfer follows the same alignment and swing arc and strikes the single golf ball. A correctly struck golf ball travels down the center of the hatched tee image 26 without striking either of the channels 14. The golfer can align the apparatus 10 to aim at various targets around the room.

This apparatus 10 can be of various sizes, but in a preferred embodiment is small enough to easily fit into a luggage case. It need not be very wide. In one embodiment, the apparatus 10 is approximately six inches wide by twelve inches in length.

It is readily apparent that one advantage to the present invention is that it is small and portable.

The apparatus 10 includes a small height so that the golfer does not make swing adjustments when transferring the putting stroke to the golf course. In fact, the height of the plate (approximately ⅛ inch) encourages the user to develop a discipline that causes him to not touch the putting green when stroking, but rather, the more desirable light brushing of the green while stroking.

Another advantage of the present invention is that the golfer gets to learn the feel of his regular golf equipment, including the golf balls 20, 22 and his putter.

Figure 4:
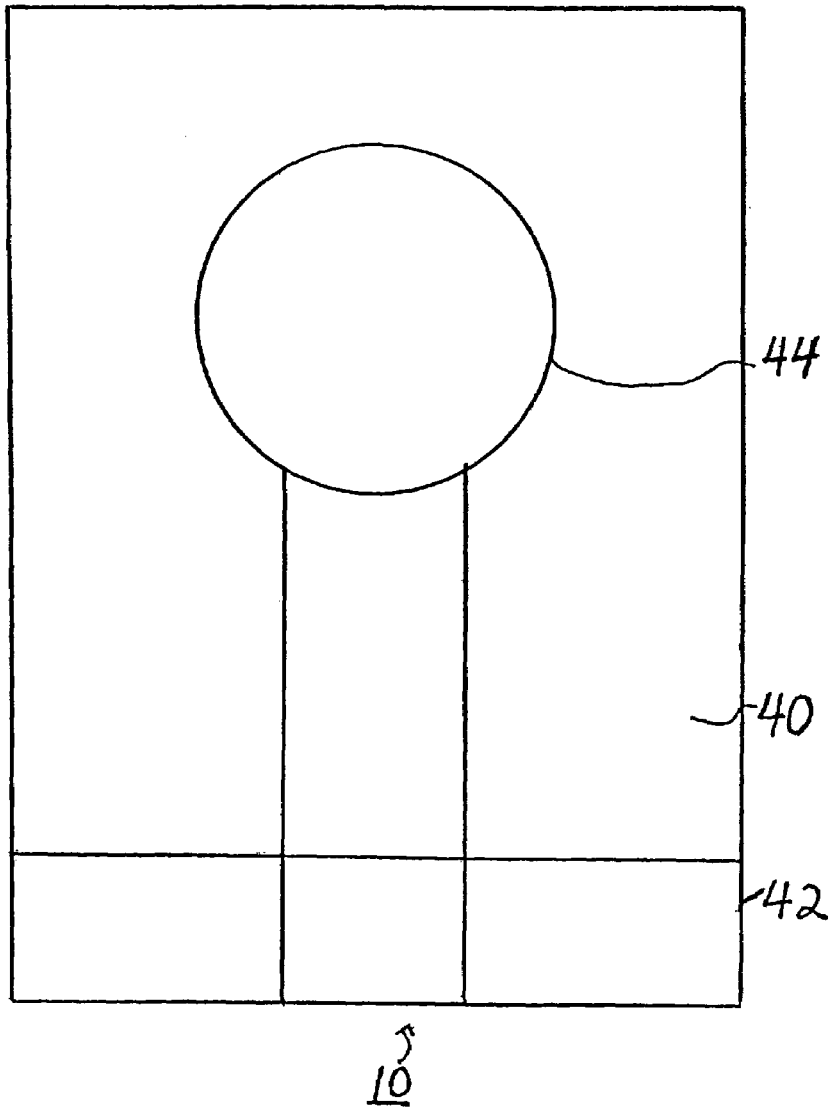
FIG. 4 is an obverse view of the reverse surface of the apparatus of FIG. 1.

Looking at another feature of the present invention depicted in FIG. 4, the reverse surface 40 of the apparatus includes a chamfered edge 42 and indicia of a golf hole 44. Thus, the golfer uses two spaced devices to practice putting from a first apparatus to a second apparatus. Then he simply turns over both golf putting apparatus to putt back.

Various changes and modifications, other than those described above in the preferred embodiment of the invention described herein will be apparent to those skilled in the art. While the invention has been described with respect to certain preferred embodiments and exemplifications, it is not intended to limit the scope of the invention thereby, but solely by the claims appended hereto.

What is claimed is:

1. A golf putting practice apparatus comprising:

an obverse surface having a pair of substantially identically shaped parallel golf ball channels, wherein each of said channels include sufficient width and depth to allow a golf ball to travel therein;

an intermediate area separating said channels, said intermediate area being of sufficient width such that a pair of golf balls placed side by side in each of said channels do not contact each other, and wherein said intermediate area is of such a width such that each of said placed golf ball can be struck simultaneously with a standard USGA putter; and a dimple disposed at a frontal end of each of said channels.

2. The golf putting apparatus of claim 1, further including a central dimple disposed between channel dimples.

3. The golf putting apparatus of claim 1, wherein each of said channels progresses in a uniform upwardly inclined plane.

4. The golf putting apparatus of claim 3, wherein each of said upwardly inclined planes terminates at a chamfered portion of said surface.

5. The golf putting apparatus of claim 1, further including a swing vertex line which defines the lowest point of a swing arc for properly striking the pair of golf balls.

6. The golf putting apparatus of claim 1, further including a center line disposed in said intermediate area situate parallel to said channels.

7. The golf putting apparatus of claim 1, wherein said surface includes a hatched cross sectional image of a golf tee, said image defining a properly directed swing arc.

8. The golf putting apparatus of claim 7, wherein said cross sectional image includes an image of a top tee portion having a width substantially similar to the width of a standard USGA putter head.

9. The golf putting apparatus of claim 1, wherein said apparatus further includes a one piece molded design or machined.

10. The golf putting apparatus of claim 9, wherein said one piece molded design is of a polycarbonate material.

11. The golf putting apparatus of claim 1, further including a reverse surface, wherein said reverse surface includes a chamfered portion and a golf hole image.

* * * * *